US009422754B2

(12) United States Patent
Graute et al.

(10) Patent No.: US 9,422,754 B2
(45) Date of Patent: Aug. 23, 2016

(54) MOTOR VEHICLE DOOR LOCK

(71) Applicant: Kiekert AG, Heiligenhaus (DE)

(72) Inventors: Ludger Graute, Essen (DE); Thomas Kippes, Meerbusch (DE)

(73) Assignee: Kiekert AG, Heiligenhaus (DE)

( * ) Notice: Subject to any disclaimer, the term of this patent is extended or adjusted under 35 U.S.C. 154(b) by 58 days.

(21) Appl. No.: 14/242,239

(22) Filed: Apr. 1, 2014

(65) Prior Publication Data

US 2014/0292002 A1 Oct. 2, 2014

Related U.S. Application Data

(63) Continuation of application No. 13/982,885, filed as application No. PCT/DE2012/000056 on Jan. 24, 2012, now abandoned.

(51) Int. Cl.

| | |
|---|---|
| ***E05B 77/38*** | (2014.01) |
| ***E05B 85/26*** | (2014.01) |
| ***E05B 77/34*** | (2014.01) |
| *E05C 3/16* | (2006.01) |

(52) U.S. Cl.

CPC ..... *E05B 85/26* (2013.01); *E05B 77/34* (2013.01); *E05B 77/38* (2013.01); *Y10T 292/1075* (2015.04)

(58) Field of Classification Search

CPC ..... E05B 77/34; E05B 77/36; E05B 77/38; E05B 77/42; E05B 85/26

USPC ..... 292/201, 216, DIG. 23, DIG. 56, 292/DIG. 57, 195, 198

See application file for complete search history.

(56) References Cited

U.S. PATENT DOCUMENTS

| | | | | |
|---|---|---|---|---|
| 3,848,911 A * | 11/1974 | Watermann | E05B 77/38 292/216 |
| 5,520,426 A * | 5/1996 | Arabia et al. | 292/337 |
| 7,090,264 B2 * | 8/2006 | Dzurko et al. | 292/337 |

(Continued)

FOREIGN PATENT DOCUMENTS

| | | |
|---|---|---|
| DE | 198 21 754 A1 | 12/1998 |
| EP | 0 159 238 A1 | 10/1985 |

(Continued)

OTHER PUBLICATIONS

International Search Report and Written Opinion for corresponding Application No. PCT/DE2012/000056 dated Sep. 10, 2012.

*Primary Examiner* — Alyson M Merlino

(74) *Attorney, Agent, or Firm* — Renner, Otto, Boisselle & Sklar, LLP

(57) ABSTRACT

A lock including a catch mechanism made up of a rotary latch and catch for latching the rotary latch. The rotary latch and catch have blocking surfaces for latching purposes. In the latched state, the blocking surface of the rotary latch rests on the blocking surface of the catch, and this prevents the rotary latch from being able to rotate in the direction of the open position. The lock also includes a component with an abutment surface, against which the blocking surface of the rotary latch butts in the open position of the catch mechanism. This abutment prevents the situation where, in the open position, dust can pass onto the blocking surface of the rotary latch. In addition, the abutment reduces the penetration of dust into the catch mechanism. An increase in the opening forces as service life increases is thus avoided.

11 Claims, 3 Drawing Sheets

(56) References Cited

U.S. PATENT DOCUMENTS

| | | | | |
|---|---|---|---|---|
| 7,503,598 | B2 * | 3/2009 | Graute | 292/216 |
| 7,845,692 | B2 * | 12/2010 | Inan et al. | 292/216 |
| 8,348,309 | B2 * | 1/2013 | Patel et al. | 292/195 |
| 2003/0222462 | A1 * | 12/2003 | Bruce | 292/216 |
| 2011/0089706 | A1 * | 4/2011 | Bendel et al. | 292/341.12 |

FOREIGN PATENT DOCUMENTS

| | | |
|---|---|---|
| EP | 0 331 832 A1 | 9/1989 |
| FR | 2 753 738 A1 | 3/1998 |

* cited by examiner

MOTOR VEHICLE DOOR LOCK

RELATED APPLICATION DATA

This application is a continuation of U.S. application Ser. No. 13/982,885 filed Jul. 31, 2013 which is a National Phase of PCT/DE2012/000056 filed Jan. 24, 2012 which claims priority of German Application No. 10 2011 003 410.2 filed Jan. 31, 2011, are of which are hereby incorporated herein by reference in their entireties.

BACKGROUND

The invention relates to a lock for a door or tailgate/gate with a catch mechanism comprising a rotary latch and a pawl for latching the rotary latch. Such a lock is, for instance, known from DE 103 20 457 A1.

The aforementioned lock allows temporary locking of openings in motor vehicles or buildings with the aid of doors or tailgates/gates. In the closed state of such a lock, the rotary latch grips around the, in particular, bow-shaped locking bolt, which in case of a vehicle is generally attached to the car body. When the rotary latch reaches a locked position after having been pivoted from an open position by means of a locking bolt, the rotary latch is finally latched by means of the pawl. A blocking surface of the pawl abuts in this case against a blocking surface of the rotary latch, preventing the rotary latch from being pivoted back in the direction of the open position. The locking bolt can no longer escape the catch mechanism in the closed position. In the closed position, the metal blocking surfaces of the rotary latch and pawl are pressed against each other during latching.

For opening, the pawl must be moved out of its latched position. Once the pawl has been moved out of its latched position, the rotary latch rotates in the direction of the opened position. In the opened position of the rotary latch and thus in the opened position of the catch mechanism, the locking bolt can escape the lock. The door and tailgate can thus be opened again.

The rotating of the rotary latch in the direction of the opened position after the pawl has been moved out of its latched position can be caused by a sealing pressure of the respective door or tailgate or by a spring. Such a rotation can also be caused by the locking bolt out being pulled out of the catch mechanism.

Locks can contain two different latched positions of the rotary latch. The rotary latch can initially be latched in the so-called intermediate closed position and then, by continued pivoting into the closed position into the so-called fully closed position. Although a locking bolt cannot escape the catch mechanism in the intermediate closed position, the respective door or tailgate/gate is, however, not fully closed. Such a door or tailgate/gate is only fully closed, when the rotary latch is turned up to the fully closed position and is latched in this position.

The rotary latch and pawl are generally rotatably mounted on the base of a lock case. The lock case is generally made of metal in order to ensure a stable fixing. In addition, arrangements generally contain amongst other elements and for weight reasons, an existing lock housing including a lock housing cover, offering protection against dirt and moisture. The lock housing and lock case form an infeed section for the locking bolt into the catch mechanism or into the infeed slot of the rotary latch.

The above characteristics can be individually or in any combination part of the lock of the invention, unless something else has been expressly disclosed.

Where two blocking surfaces are pressed against each other for latching and dust settles on the surfaces, the forces required for opening the catch mechanism can increase with increasing age. To reduce the opening forces that can be generated by dust entering and settling on the blocking surfaces pressing against each other, such blocking surfaces of the rotary latch and pawl are made of metal. A normally used plastic coating is thus no longer required. Dust particles can, however, also cause said increase in opening forces when such metal surfaces are used, so that further measures are required.

SUMMARY OF THE INVENTION

It is a task of the present invention to provide a lock preventing an increase of opening forces.

To solve this task, a lock contains the characteristics of claim 1. Advantageous embodiments are shown in the sub claims.

To solve this task, the invention provides a lock with a catch mechanism comprising a rotary latch and pawl for latching the rotary latch. The rotary latch and pawl contain blocking surfaces for latching. In the latched state, the blocking surface of the rotary latch rests on the blocking surface of the pawl, preventing the rotary latch from being able to rotate in the direction of the opened position. The lock also comprises a component with an abutment surface with at least one abutment surface, against which the blocking surface of the rotary latch abuts in the open and/or in at least one of the latched positions. When the rotary latch abuts in its latched position against one of the abutment surfaces of the component, this is, in particular, due to a shape, i.e. a lateral surface of the load arm. Abutting means in this case that a surface of the rotary latch is arranged directly opposite the abutment surface and that both surfaces are only separated by a small gap. Preferably the gap is no wider than 0.5 mm wide, and particularly preferably no wider than 0.2 mm and even more preferably no wider than 0.1 mm. The narrower the gap, the less dust can disadvantageously enter the lock in its latched state. By maintaining a small gap, frictional forces are avoided which could make the actuation of the catch mechanism more difficult. Preferably, a surface of the rotary latch abuts against one abutment surface of the component in the fully closed position and in the intermediate closed position. In every latched position of the catch mechanism the ingress of dust in the lock is reduced. Where the blocking surface of the rotary latch rests against an abutment surface of the component in the opened position of the catch mechanism, a surface of the rotary latch is in contact with an abutment surface of the component. The surface of the rotary latch, which then rests against an abutment surface of the component is, in particular, a blocking surface of the rotary latch. First of all, this arrangement prevents any dust from settling on the blocking surface of the rotary latch in the opened position, which could result in greater opening forces. The arrangement also prevents any dust from entering the catch mechanism in the opened position. This contributes to preventing an increase in opening forces.

Where the catch mechanism includes an intermediate closed position and a fully closed position, the blocking surface of the rotary latch rests, in its open position, against the abutment surface used for latching in the fully closed position. In particular the rotary latch blocking surface for the fully closed position causes, in case of a dust deposit, an increase in opening forces, so that this blocking surface of the rotary latch is advantageously protected against dust.

The blocking surface of the rotary latch resting in the opened position against the abutment surface is made of metal in one embodiment. Preferably the component with an abutment surface is made of elastomer. Where the component with an abutment surface is made of elastomer, an advantageous particularly tight connection is created between the blocking surface of the rotary latch and the abutment surface in the opened state of the catch mechanism. This particularly effectively prevents any ingress of dust which could cause increased opening forces.

In one embodiment, the component with an abutment surface is laterally supported by one or two walls, abutting the abutment surfaces or which are arranged opposite an abutment surface. The walls contribute to the stable position of the component with an abutment surface. The dust-preventing effect of the component with an abutment surface is thus improved further.

In order to minimize the number of components, the said one or two walls are preferably made of one part and are preferably connected with a lock housing made of plastic.

In a preferred embodiment, the component with an abutment surface is, at the same time, a damping element for the locking bolt and/or for the rotary latch. Embodiments and advantages of the damping element are disclosed in DE 103 20 457 A1. The known advantages of this embodiment can also be achieved with this lock when the component with an abutment surface is also a damping element for the locking bolt and/or for the rotary latch in the manner disclosed in DE 103 20 457 A1. We include the respective disclosure content of DE 103 20 457 A1 in the invention.

Preferably the damping element is designed as an L-shaped insert DE 103 20 457 A1 for a seating groove. In addition, one embodiment of the damping element contains a protruding extension including the abutment surface. The single-piece design keeps the number of components to a minimum.

The long L-leg of the damping element is designed as a holding leg and the short L-leg of the damping elements is designed as a damping leg for the locking bolt and the rotary latch, in particular in the manner and for the reasons disclosed in DE 103 20 457 A1.

Preferably the holding leg contains recesses facilitating transverse sliding into the seating groove in the manner and for the reasons disclosed in DE 103 20 457 A1. The damping leg contains, in particular on the inside, a locking bolt stop face and, on the outside, a rotary latch stop face in the manner and for the reasons disclosed in DE 103 20 457 A1. Preferably, the infeed section and the seating groove are essentially arranged in parallel to and amongst each other in the manner and for the reasons disclosed in DE 103 20 457 A1. In one embodiment, the infeed section and the seating groove together form an infeed insert for a lock housing in the manner and for the reasons disclosed in DE 103 20 457 A1. Preferably, the damping leg protrudes at least partly from the infeed insert in the manner and for the reasons disclosed in DE 103 20 457 A1. In particular, the damping element contains a temporarily closed cover for inserting, for instance, an emergency locking tool in the manner and for the reasons disclosed in DE 103 20 457 A1.

One embodiment of the invention contains a linear elevation on which the rotary latch rests. In particular, the rotary latch rests on said linear elevation in every position. The linear elevation commences preferably with a stage or a projection of the damping element or of the component with the abutment surface and extends, in particular, initially parallel to an infeed section of the lock. On the inside base of the infeed section, the arch-shaped elevation departs in one embodiment from the infeed section and extends in an arch shape initially around this internal end or this base of the infeed section. The linear elevation furthermore contributes to preventing dust from entering the lock. The linear elevation is, in particular, part of a wall of the lock housing.

BRIEF DESCRIPTION OF THE DRAWINGS

Below the invention is explained in detail with reference to figures.

In which.

DETAILED DESCRIPTION

Figure 1:
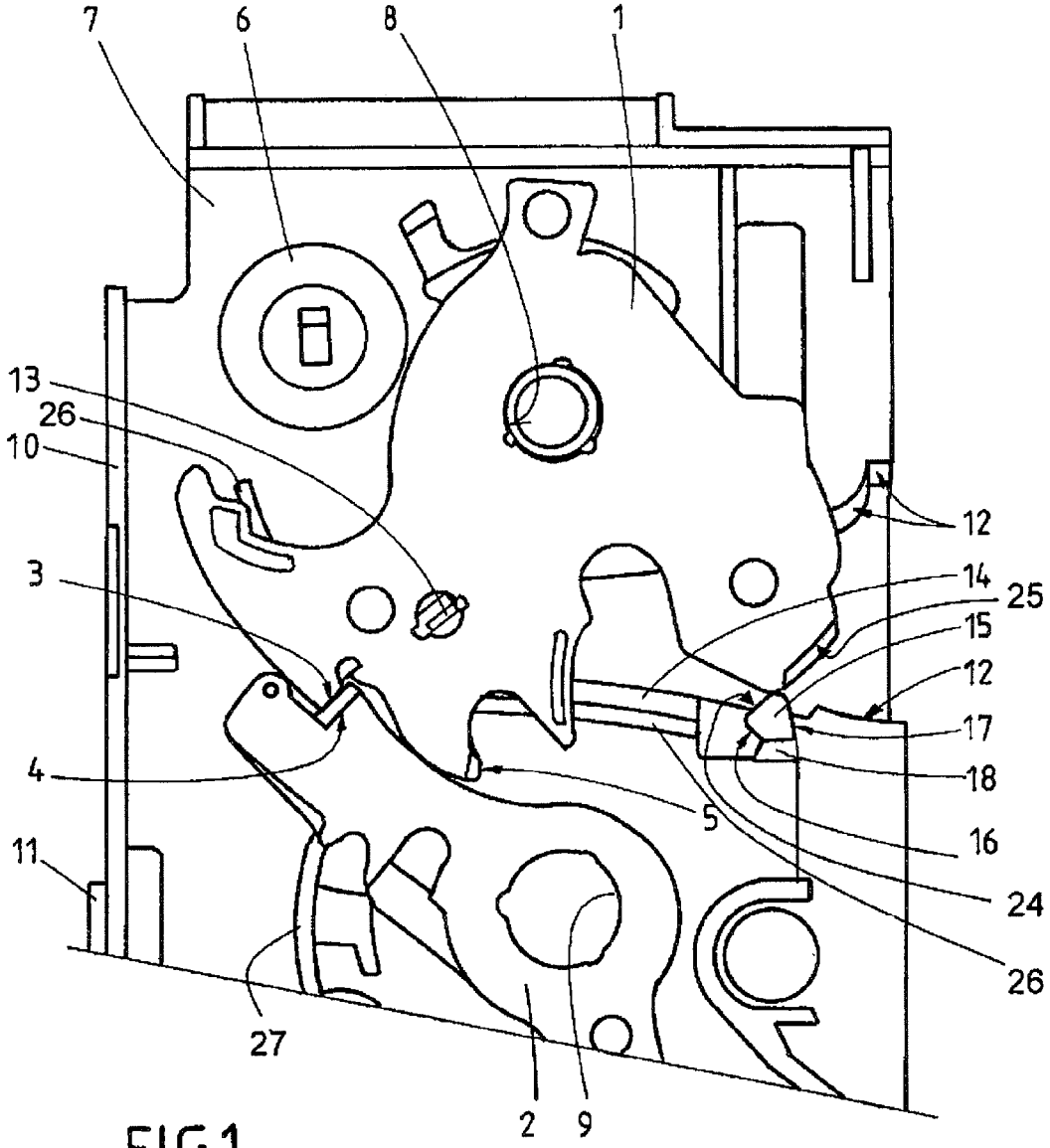
FIG. 1: shows a latched catch mechanism with a rotatably mounted rotary latch

FIG. 1 shows a catch mechanism with a rotatably mounted rotary latch 1 and a rotatably mounted pawl 2. In FIG. 1, the catch mechanism is in the intermediate closed position. A metal blocking surface 3 of the rotary latch 1 is pressed against a metal blocking surface 4 of the pawl 2. The rotary latch 1 can therefore not be turned counter clockwise in the opened position.

Figure 2:
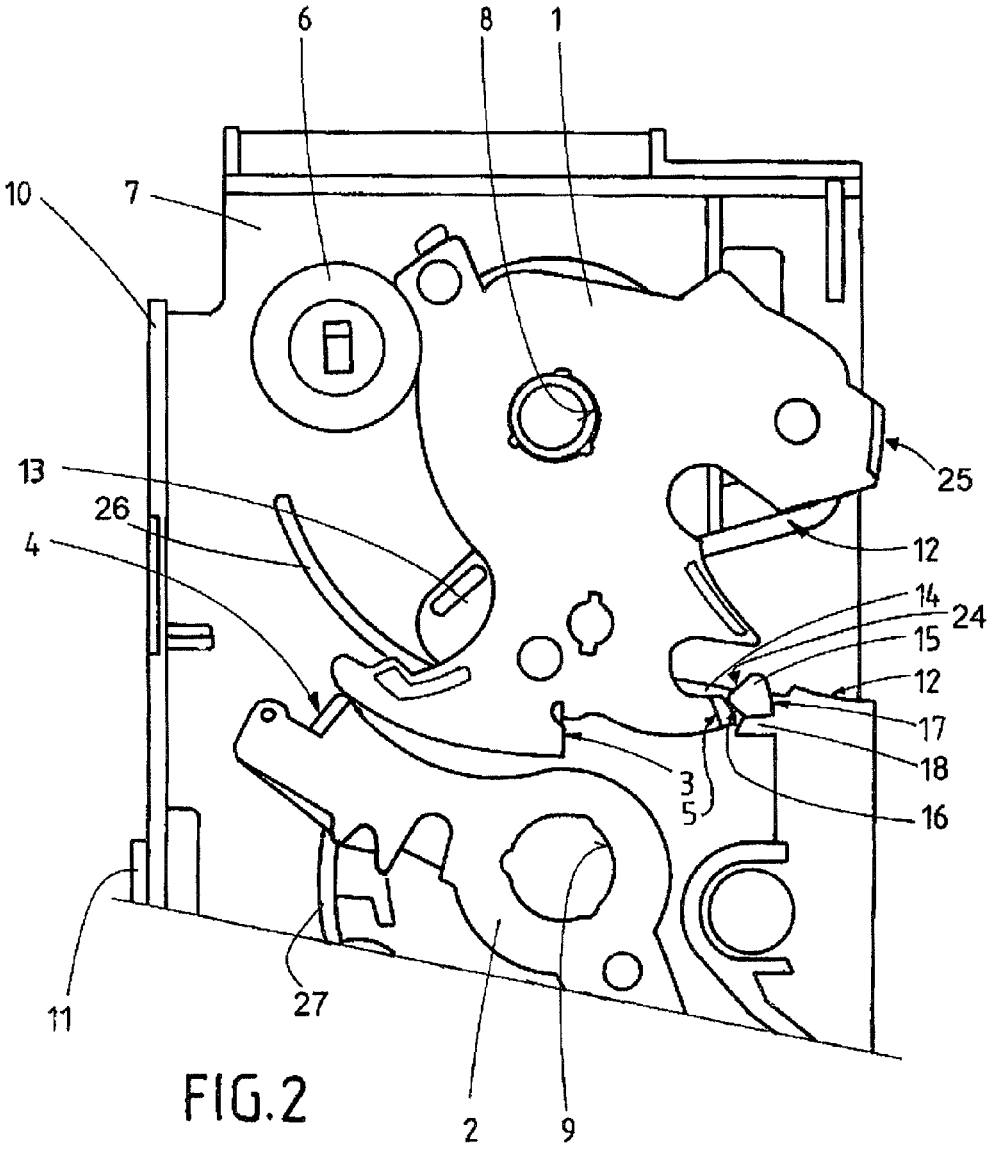
FIG. 2: shows a catch mechanism in the opened position

The rotary latch 1 contains a further metal blocking surface 5, pressed against the blocking surface 4 of the pawl 2 in the fully closed position. Where the rotary latch 1 shown in FIG. 1 is turned further in clockwise direction, the catch mechanism finally assumes this fully closed position. A stop 6 formed by a ring made from elastic material, limits the rotary movement of the rotary latch 1 in clockwise direction as well as in counter-clockwise direction, as shown in FIG. 2.

A wall 7 of a plastic lock housing is located below the rotary latch 1 shown in FIG. 1. Below this plastic wall 7 a metal and, in particular, U-shaped reinforcement plate is provided, retaining the axes, extending through holes 8 and 9 of the rotary latch and pawl to provide the rotatable mounting. As a whole, the reinforcement plate extends in a U-shape around the infeed section of the lock. The two legs of the U contain holes accommodating the two said axes. Only a metal side wall 10 is shown of the lock case, so as to not obstruct the view onto the catch mechanism. The base of the metal lock case is thus in FIG. 1 located above the rotary latch 1 and above the pawl 2. The side wall 10 forms a right angle with the base of the lock case. A lateral tab 11 of the lock housing engages in a recess in the lock case side wall 10 and serves to fix the lock housing wall 7 to the lock case. The lock housing wall 7 forms an integral part with the perpendicular wall 12 of the lock housing. The transition from the lock housing wall 7 to the two walls 12 forms in each case a right angle. Together with the adjacent areas of the lock plate the walls 12 form an infeed section for a locking bolt. The infeed section can also be covered on one side by a wall of the lock housings. The walls 12 are funnel-shaped on the inside towards each other and finally abut against the short leg 13 of a mainly L-shaped damping element made of elastomer, located on a plane below the rotary latch. The short leg 13 can dampen the locking bolt striking the base of the funnel formed by the two wall areas 12. The short leg 13 is therefore also referred to as the damping leg.

Apart from the projection 15, the L-shaped damping element is preferably arranged and operates in the same manner as disclosed in the German patent application DE 103 20 457 A1.

The damping element contains a long leg 14—also referred to as retaining leg—at whose end a projection 15 is arranged extending upwards in FIG. 1. The projection 15 forms the component with an abutment surface 16 for the main blocking surface 5 of the rotary latch 1 in the opened position of the catch mechanism and an abutment surface 24. At least a lateral contour 25 of the load arm of the rotary latch 1 abuts the abutment surface 24 in the fully closed position. The damping element is a single piece and is, including projection 15, made of elastomer. Two wall areas of the projection 15 are supported by a wall area 17 of the lock housing as well as by a web 18 of the lock housing. The supporting wall area 17 extends vertically upwards when viewed from the lock case surface 7. The web 18 includes side walls which also extend vertically upwards in the same manner. Such a side wall of the web 18, extending vertically upwards, supports the projection 15 abutting against said side wall.

The lock housing wall 7 contains a linear elevation 26, which initially runs parallel to a lateral boundary of the infeed section and which in this case is mainly straight. In particular, one end of the linear elevation abuts against a raised area of the damping element and, in particular, against a step 23 of the damping element shown in FIG. 3 or directly against the projection 15 of the component with an abutment surface. On the internal end of the infeed section, the linear elevation 26 departs from the infeed section and runs in an arch shape in the direction of the stop 6. During its rotary movement the rotary latch 1 always rests on the linear elevation 26 during its pivoting movement and thus in any position. All in all, the linear elevation contributes to less dust being able to enter the inside of the lock.

A respective linear elevation 27 is provided for the pawl 2. The pawl 2 rests on this linear elevation 27 and that in each position. Again this reduces the amount of dust entering critical parts of the lock.

FIG. 2 shows the catch mechanism in the opened position. The blocking surface 5 of the rotary latch 1 rests against the abutment surface 16 of the projections 15 in the aforementioned manner, preventing the ingress of dust. The circular stop 6 also restricts the rotary counter-clockwise movement of the rotary latch 1. The arm of the pawl 2 surrounding the blocking surface 4 rests against a lateral contour of the rotary latch 1, without latching said latch. Generally, the abutment surface 6 suffices to restrict the rotary movement of the rotary latch 1 in the opening direction, i.e. in FIG. 2 in counter-clockwise direction. The stop 6 is therefore not absolutely necessary for restricting the movement.

Figure 3:
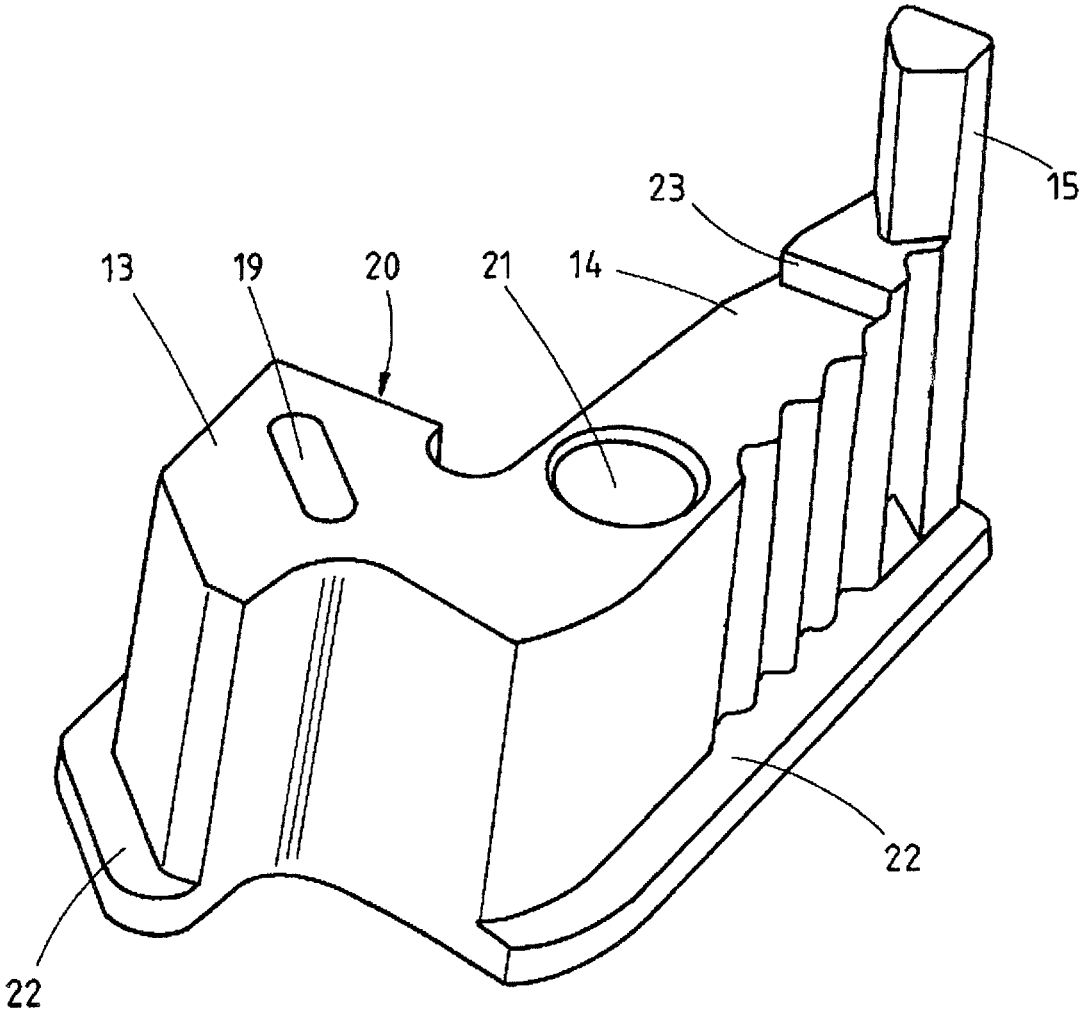
FIG. 3: shows a damping element

FIG. 3 shows a preferred embodiment of a single-piece damping element with a short leg 13, a long leg 14 and a projection 15 protruding from one end of the long leg 14.

The short leg 13 preferably contains a recess 19, providing an improved damping of the locking bolt striking the lateral surface 20. The long leg 14 preferably contains a hole 21 into which a bolt, not shown, with an external diameter corresponding to the internal diameter of the hole 21 and preferably being slightly larger, is inserted. The bolt is made of a comparable non-elastic material and, in particular, of a rigid plastic material. This improves the stability of the damping element when the damping element is inserted into a respective recess into which it is, preferably, clipped. The recess can be formed by the lock housing or can be connected to it to form a single piece. Preferably the recess is partly formed by a wall 12 of the infeed section, which is stabilized as a result. Optionally provided ribbed lateral surfaces of the damping element facilitate insertion in said recess. Preferably the (bottom) side, facing the (top) side with the projection 15 contains laterally protruding surfaces 22, restricting the insertion of the damping element in said recess and thus ensures a correct insertion. Said recess can include a protruding tab which, when inserted, abuts against the (bottom) side facing the (top) side with the projection 15, in order to improve the retention of the damping elements in the recess. The tab is, preferably, also connected to the lock housing to form a single piece. A step 23 optionally provided on the (top) side can be inserted in a slot provided for this purpose in the recess in order to further improve the stability of the abutting projection 15.

LIST OF REFERENCE NUMBERS

1 Rotary latch
2 Pawl
3 Blocking surface for intermediate locking position
4 Blocking surface of pawl
5 Metal blocking surface for fully closed position
6 Stop
7 Lock housing wall
8 Hole in rotary latch
9 Hole in pawl
10 Metal side wall of lock case
11 Lateral tab of lock housing
12 Wall of lock housing
13 Short damping leg
14 Long holding leg
15 Component with an abutment surface in form of a projection
16 Abutment surface of component
17 Wall area of lock housings
18 Web of lock housings
19 Recess in damping leg
20 Lateral surface of damping leg
21 Hole in holding leg
22 Laterally protruding surfaces of damping element
23 Step of damping element
24 Abutment surface
25 Lateral contour
26 Linear elevation for rotary latch
27 Linear elevation for pawl

What is claimed is:

1. A lock comprising:

a catch mechanism including a rotary latch moveable between an opened position, an intermediate closed position, and a fully closed position, and a pawl for latching the rotary latch in the intermediate and fully closed positions, wherein the rotary latch includes a first blocking surface and a second blocking surface, wherein the pawl includes a blocking surface that presses against the first blocking surface, latching the rotary latch in the intermediate closed position, and presses against the second blocking surface, latching the rotary latch in the fully closed position, and a damping element having a body located in a plane below the rotary latch and a projection extending into a plane in which the rotary latch lies, wherein the projection has first and second abutment surfaces, wherein one of the first and second blocking surfaces of the rotary latch rests against the first abutment surface in the opened position of the rotary latch, and wherein the second abutment surface abuts against an outer surface of the rotary latch in the fully closed position.

2. The lock according to claim 1, wherein the blocking surface of the rotary latch, which rests against the first abutment surface when the rotary latch is in the opened position, is the second blocking surface of the rotary latch.

3. The lock according to claim 1, wherein the first and second blocking surfaces are made of metal and/or the damping element with the first and second abutment surfaces is made of an elastomer.

4. The lock according to claim 1, wherein the damping element is supported by one or two walls and/or a web.

5. The lock according to claim 4, wherein the one or two walls and/or the web are connected and form a single piece with a lock housing made of plastic.

6. The lock according to claim 1, wherein the body of the damping element is an L-shaped insert for a seating groove from which the projection extends.

7. The lock according to claim 6, wherein a long leg of the L-shaped insert is a holding leg and a short leg of the L-shaped insert is a damping leg for a locking bolt.

8. The lock according to claim 7, wherein the damping leg of the damping element contains a hole into which a bolt made of a rigid material is inserted.

9. The lock according to claim 1, further comprising a linear elevation on which the rotary latch rests in each position of the rotary latch.

10. The lock according to claim 9, wherein the linear elevation abuts against the damping element or against a step on which the damping element is located.

11. A door of a motor vehicle with a lock according to claim 1.

* * * * *